US005766706A

United States Patent [19]

Custer et al.

[11] Patent Number: 5,766,706

[45] Date of Patent: Jun. 16, 1998

[54] GAS SCAVENGING ARRANGEMENT

[75] Inventors: Richard G. Custer, Appleton; Randy A. Mazzocchi, Greenville; Wesley W. Fietzer, Appleton, all of Wis.

[73] Assignee: Reynolds Consumer Products, Inc., Appleton, Wis.

[21] Appl. No.: 670,868

[22] Filed: Jun. 26, 1996

[51] Int. Cl.[6] ..... B29D 22/00

[52] U.S. Cl. ..... 428/35.2; 428/35.4; 428/35.7; 428/36.6; 428/36.7; 428/36.9

[58] Field of Search ..... 428/35.2, 35.4, 428/35.7, 36.6, 36.7, 36.9

[56] References Cited

U.S. PATENT DOCUMENTS

| | | | |
|---|---|---|---|
| 4,048,361 | 9/1977 | Valyi | 428/35 |
| 4,279,350 | 7/1981 | King | 215/228 |
| 4,287,995 | 9/1981 | Moriya | 215/228 |
| 4,536,409 | 8/1985 | Farrell et al. | 426/398 |
| 4,702,966 | 10/1987 | Farrell et al. | 428/500 |
| 5,049,624 | 9/1991 | Adams et al. | 525/371 |
| 5,075,362 | 12/1991 | Hofeldt et al. | 524/72 |
| 5,106,886 | 4/1992 | Hofeldt et al. | 523/100 |
| 5,202,052 | 4/1993 | Zenner et al. | 252/188.28 |
| 5,204,389 | 4/1993 | Hofeldt et al. | 524/72 |
| 5,445,856 | 8/1995 | Chaloner-Gill | 428/35.9 |
| 5,492,742 | 2/1996 | Zenner et al. | 428/35.2 |

FOREIGN PATENT DOCUMENTS

| | | |
|---|---|---|
| 0328336 | 8/1989 | European Pat. Off. . |

OTHER PUBLICATIONS

Ageless® Oxygen Absorber—A New Age in Food Preservation, Mitsubishi Gas Chemical Company, Inc., date unknown.

*Primary Examiner*—Randy Gulakowski
*Attorney, Agent, or Firm*—Alan T. McDonald

[57] ABSTRACT

A gas scavenging arrangement for a flexible polymeric package having first and second opposing films, comprises a polymeric carrier strip carrying a gas scavenging material and disposed within the package between the first and second films. The carrier strip is attached directly or via an intermediary base strip to one of the films of the package. In one embodiment, this base strip forms part of a reclosable zipper.

7 Claims, 3 Drawing Sheets

GAS SCAVENGING ARRANGEMENT

FIELD OF THE INVENTION

The present invention relates to flexible polymeric packages and, more particularly, relates to a gas scavenging arrangement for a flexible polymeric package.

BACKGROUND OF THE INVENTION

In many commercial applications it is desirable to remove or minimize certain gases in a package. For instance, in the food packaging industry, it is important to prevent gas from building up and from remaining in a package containing certain products. Excess atmospheric gas as well as gas given off by food products themselves promotes rapid spoilage. This is particularly true with respect to packages which contain items such as meat, cheese, fruits, and even coffee.

Atmospheric molecular oxygen ($O_2$) is a common culprit in promoting food spoilage. Molecular oxygen is reduced to a variety of quite reactive free radical species which oxidize carbon-carbon double bonds in foods and other perishable products. Such oxidation by free radicals adversely affects the odor and flavor of certain foods and can affect the stability and performance of certain non-food products such as pharmaceuticals, dyes and adhesives.

In addition to spoilage by atmospheric gases, food products themselves can give off gases which promote rapid spoilage. For instance, certain fruits give off ethylene, and cheeses may emit other by-products.

In addition to preventing food spoilage, it is desirable to store items in a package which may be repeatedly opened and closed. For example, when dealing with packaged foods such as sliced luncheon meats, the consumer may initially use only a portion of the meats contained in a package. By providing a package which may be reclosed, the consumer avoids having to locate a storage container for the unused portion of the food in the package. It will be appreciated that reclosable packaging appreciably enhances the marketability of such products.

A typical reclosable package is hermetically sealed by any suitable means, e.g., by a peel seal, a cut-off top, or a combination of a peel seal and a perforation top, which protects the integrity of the package until the consumer initially opens the package. By providing a reclosable zipper at the package opening, the consumer may manually reseal the package after its use.

The reclosable means may include a pressure fastenable seal in the form of a rib or male member located on one package wall and a mating groove or female member located on an opposing package wall. This reclosable means is oftentimes referred to as a zipper.

It would be desirable to incorporate both a reclosable closure arrangement and a gas scavenging material into a food package and thus accomplish the dual goals of allowing for a resealable package whereby the shelf and cupboard life of food products contained therein is enhanced.

Attempts have been made to incorporate gas scavenging materials into packaging systems for food and other materials. A common gas scavenging arrangement is to incorporate the gas scavenger materials into sachets or packets. These sachets or packets are not, however, optimal for use in food packaging because of the possibility of inadvertently contaminating the food with the powdered contents of a packet if the packet is broken or otherwise poisoning the consumer if the packet is ingested. Furthermore, these individual packets must be of multilayer construction for proper storage and handling of the gas scavenging material, thereby incurring added cost.

Gas scavenging liners having gas scavenging material incorporated into the material of the liner itself have been placed in beer bottlecaps to absorb oxygen which can ruin the flavor and appearance of beer. U.S. Pat. No. 5,106,886. In addition, gas scavenging materials have been incorporated into the wall of a bottle or rigid plastic container to scavenge oxygen. U.S. Pat. No. 4,702,966.

There is a need in the flexible packaging industry for an inexpensive gas scavenging arrangement in a flexible package which effectively scavenges gases from food and other products without contaminating those products. Furthermore, there is a need to develop a method of making the same to effectively scavenge gases from food and other products.

SUMMARY OF THE INVENTION

The present invention addresses the need to effectively scavenge gases in packaged materials in order to promote the shelf and cupboard life of the products. The invention is particularly useful in solving the problems associated with the buildup and retention of atmospheric and food-produced gas in food packages.

Specifically, in a first group of embodiments, the present invention provides a gas scavenging arrangement for a polymeric package having first and second opposing films, the arrangement having a polymeric carrier strip carrying a gas scavenging material and located within the package between the first and second films.

In a first preferred embodiment, the carrier strip of the gas scavenging arrangement is attached to the first film of the package.

In a second preferred embodiment, the gas scavenging arrangement further includes a first base strip having inner and outer surfaces such that the outer surface of the first base strip is attached to the first film and the carrier strip is attached to the inner surface of the first base strip. In one variation of the second embodiment, the carrier strip is fastened to the first base strip by means of a locking profile extending inwardly from the first base strip. This locking profile secures the carrier strip thereto.

In another variation of the second embodiment, a second base strip opposes the first base strip. Both strips are located in proximity to the mouth end of the package and each strip has an integrally formed interlocking closure profile which extends inwardly toward the opposite profile. The carrier strip may be located above the first closure profile so that the first closure profile is closer than the carrier strip to the interior of the package. Alternatively, the carrier strip may be located below the first closure profile so that the carrier strip is closer than the first closure profile to the interior of the package.

In yet a third preferred embodiment, the gas scavenging arrangement includes a carrier strip which is attached directly to the first film of the package and the package also includes a reclosable zipper disposed at the mouth end of the package. The reclosable zipper includes first and second opposing base strips attached to the respective first and second films. The base strips have integrally formed first and second interlocking closure profiles which extend inward from the base strips and the carrier strip is located below the reclosable zipper so that the carrier strip is closer to the interior of the package than the reclosable zipper.

In still a fourth preferred embodiment, the gas scavenging arrangement includes a carrier strip which is a first pressure-sensitive adhesive strip attached to the first film in proximity to the mouth end of the package and further includes a second pressure-sensitive adhesive strip opposing the first pressure-sensitive adhesive strip which also carries a gas scavenging material so that the first and second pressure-sensitive strips are releasably sealable to each other. In a variation of that embodiment, first and second pressure-sensitive strips that carry gas scavenging material are detachably connected to each other to form a breakable or peelable seal therebetween.

In especially preferred chemical embodiments, the carrier strip contains a carrier polymer selected from the group consisting of polyolefins, modified polyolefins, polyurethanes, polyamides, elastomers and mixtures thereof. The gas scavenging material is an oxygen scavenger including transition metal complexes or chelates of organic polycarboxylic acids.

The present invention further contemplates a method of manufacturing a gas scavenging arrangement for a package having first and second opposing films, the method comprising the steps of forming a polymeric carrier strip carrying a gas scavenging material and locating the polymeric carrier strip within the package between the first and second films. The carrier strip may be attached to the first film.

In an especially preferred embodiment, the manufacturing method further includes the steps of forming a first base strip having inner and outer surfaces, attaching the outer surface of the first base strip to the first film, and affixing the carrier strip to the inner surface of the first base strip. The steps of forming said carrier strip and first base strip can be performed simultaneously by co-extruding the carrier strip adjacent to said first base strip. Alternatively, the carrier can be coated onto the first base strip. In a most preferred embodiment, a second base strip is formed opposing the first base strip such that the first and second base strips are located in proximity to a mouth end of the package. First and second closure profiles are integrally formed with the base strips and extend inwardly from the respective first and second base strips.

BRIEF DESCRIPTION OF THE DRAWINGS

Other objects and advantages of the invention will become apparent upon reading the following detailed description and upon reference to the drawings in which.

Figure 1:
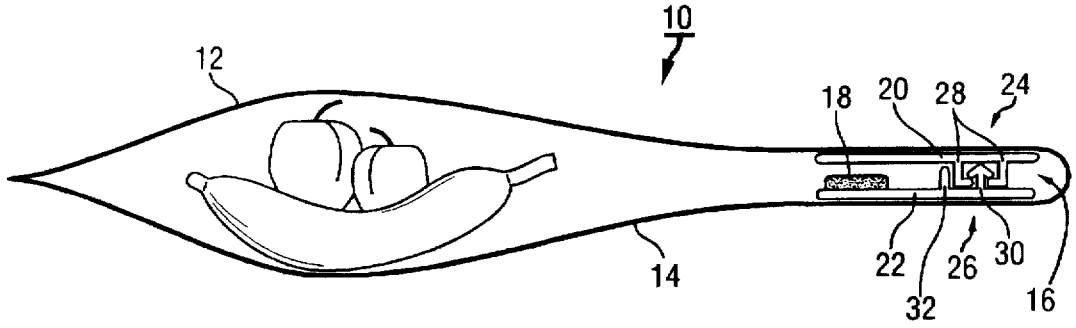
FIG. 1 is a cross-sectional view of a reclosable polymeric package including a gas scavenging arrangement having a gas scavenging carrier strip disposed on the product side of the closure arrangement.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIG. 1 illustrates a flexible polymeric package 10 including a pair of opposing films 12, 14, a closure arrangement 16 and a carrier strip 18. The carrier strip 18 incorporates a gas scavenging material. The closure arrangement 16 includes a pair of base strips 20, 22, and the carrier strip 18 is affixed to the base strip 22 either by coextrusion or as a coating.

To provide the closure arrangement 16 with a reclosable zipper, the closure arrangement 16 includes a female closure profile 24 and a male closure profile 26. The female closure profile 24 is integrally formed with and extends inwardly from the upper flange portion of the first base strip 20 and includes a pair of flexible locking members 28 with hooks at the ends thereof. The male closure profile 26 is integrally formed with and extends from the inner surface of the second base strip 22 and includes a single locking member 30 with an expanded head.

The pair of locking members 28 are disposed opposite the single locking member 30 and are spaced by a sufficient distance that the expanded head of the single locking member 30 is releasably engageable between the pair of locking members 28 and interlock with the single male locking member 30 in a snapping action caused by bringing the hooks of the pair of locking members 28 past the expanded head of the locking member 30. To facilitate alignment of the pair of locking members 28 with the locking member 30 during reclosure, the male closure profile 26 is provided with a guide post 32 for guiding one of the pair of locking members 28 between the guide post 32 and the locking member 30. If desired, the closure arrangement 16 may be designed without the base strips 20, 22 so that the closure profiles 24, 26 are attached directly to the respective opposing films 12, 14 of the reclosable package.

Analogous features in FIGS. 1–7 are identified by the same reference numerals.

Figure 2:
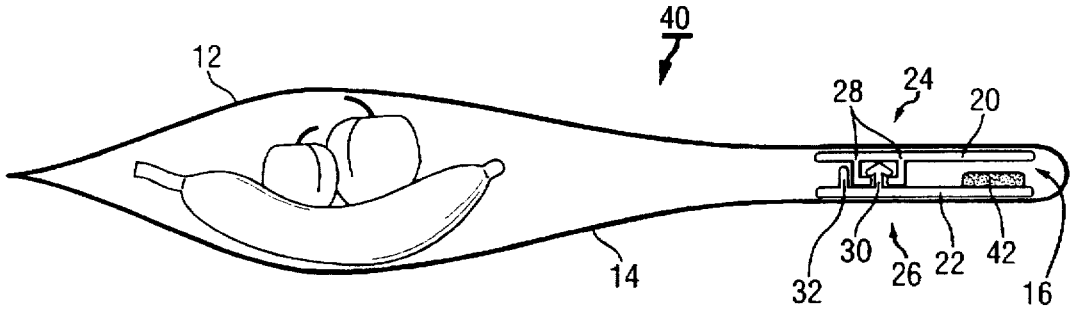
FIG. 2 is cross-sectional view of a reclosable polymeric package including a gas scavenging arrangement having a gas scavenging carrier strip disposed on the consumer side of the closure arrangement.

FIG. 2 illustrates a reclosable package 40 having a gas scavenging arrangement that is similar to that depicted in FIG. 1 except that the carrier strip 42 incorporating the gas scavenging material is located on the consumer versus the product side of a base strip 22 of the closure arrangement 16.

Figure 3:
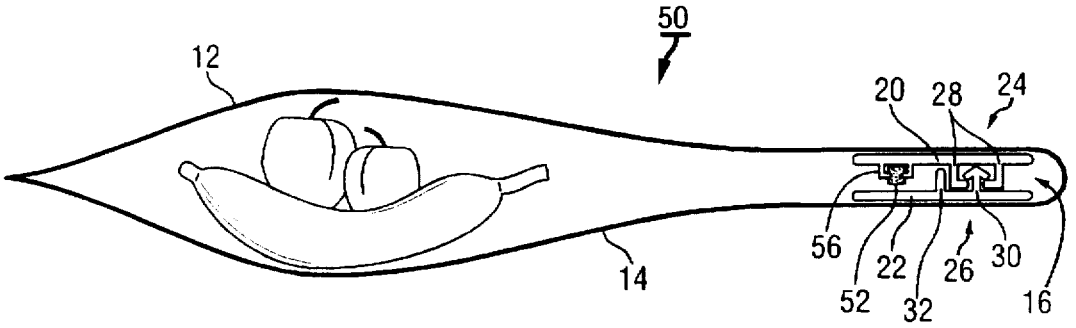
FIG. 3 is a cross-sectional view of a reclosable polymeric package including a gas scavenging arrangement having a separate locking profile holding a gas scavenging carrier strip.

FIG. 3 depicts a reclosable package 50 having a gas scavenging arrangement whereby the carrier strip 52 is not co-extruded with or coated onto a base strip of a closure arrangement, but rather is secured to the base strip 20 via a locking profile 56 integrally formed with and extending inwardly from an inner surface of the base strip 20.

Figure 4:
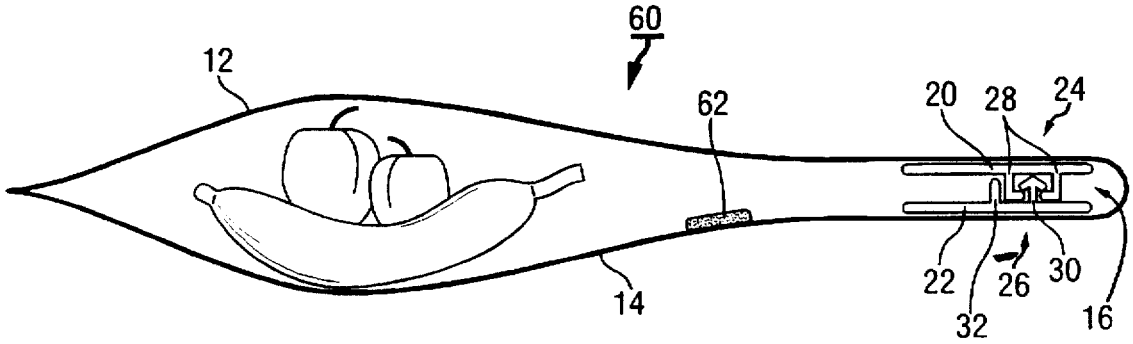
FIG. 4 is a cross-sectional view of a reclosable polymeric package including a gas scavenging arrangement having a gas scavenging carrier strip attached directly to the surface of the polymeric film of the package.

FIG. 4 depicts a reclosable package 60 having a gas scavenging arrangement whereby the carrier strip 62 is attached directly to the film 14 of the polymeric package. As is the case where the carrier strip is attached to a base strip, the carrier strip 62 can be co-extruded with or coated onto the polymeric film 14.

Figure 5:
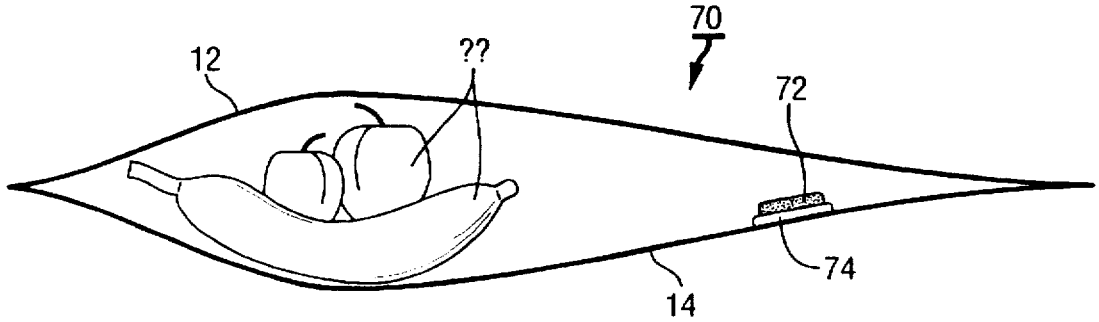
FIG. 5 is a cross-sectional view of a polymeric package including a gas scavenging arrangement having a gas scavenging carrier strip attached to the surface of the polymeric film of the package via an intermediary sealant strip.

Alternatively, as depicted in the flexible polymeric package 70 in FIG. 5, the carrier strip 72 of the gas scavenging arrangement can be attached to the film 14 of the polymeric package via a heat sealable polymeric or intermediary adhesive-based sealant strip 74.

Figure 6:
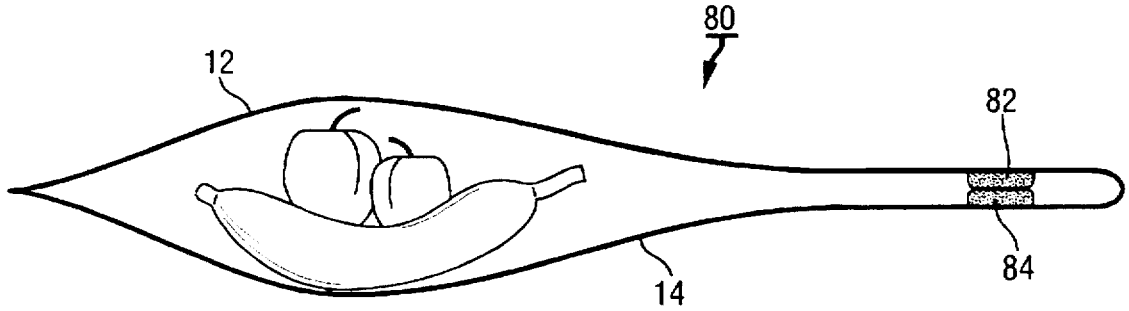
FIG. 6 is a cross-sectional view of a polymeric package including a gas scavenging arrangement having a pressure-sensitive seal incorporating a gas scavenging material.

FIG. 6 illustrates a flexible polymeric package 80 having a gas scavenging arrangement whereby the closure does not consist of a reclosable zipper having male and female closure profiles, but instead consists of two opposing pressure-sensitive adhesive strips 82, 84. The carrier strip is one and the same as at least one of the pressure-sensitive seals in that the compositions making up the carrier material and the gas scavenging material are incorporated directly into the pressure-sensitive adhesive material. The pressure-sensitive strips 82, 84 are releasably sealable to each other.

Figure 7A:
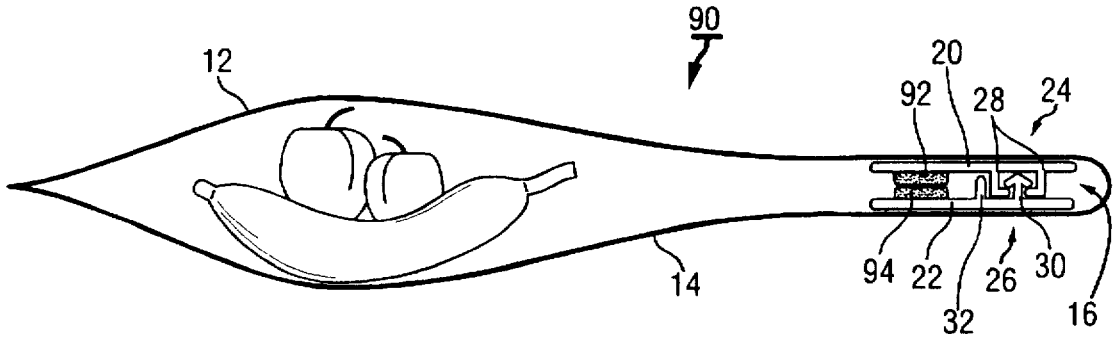
FIG. 7A is a cross-sectional view of a reclosable polymeric package including a gas scavenging arrangement having gas scavenging carrier strips detachably sealed together.
Figure 7B:
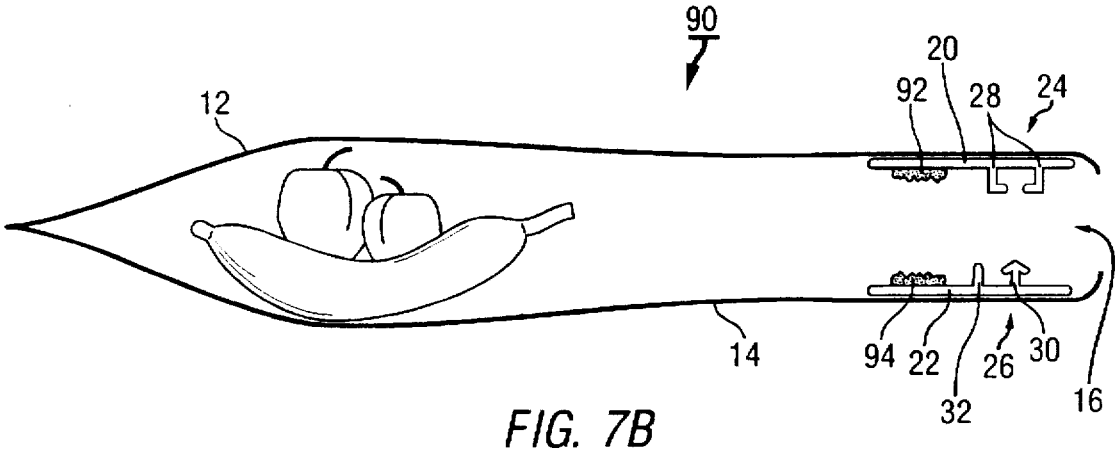
FIG. 7B is a cross-sectional view of the reclosable polymeric package in FIG. 7A showing the gas scavenging carrier strips separated from each other.

FIGS. 7A and 7B illustrate a flexible reclosable package 90 having a gas scavenging arrangement whereby carrier strips 92, 94 are in the form of first and second sealable carrier strips which are attached to the base strips 20, 22 making up the closure arrangement. In FIG. 7A, the first and second sealable strips 92, 94 are detachably connected to each other to form a breakable or peelable seal therebetween. In FIG. 7B, the breakable seal formed by the first and second sealable strips 92, 94 is broken. This embodiment is particularly useful when gas scavenging is needed by the consumer long after the bag is produced. The gas scavenging material is extruded on the inner surface of the base strips. The consumer can then pull the two base strips apart to break the seal and expose the gas scavenging material to the gas contained within the package.

Compositions of Components of the Flexible Package

In a prototypical flexible polymeric package including the gas scavenging arrangement of the present invention, the base strips 20, 22 and integrally formed closure profiles 24, 26 making up the reclosable zipper consist essentially of a mixture of polyethylene, polypropylene, copolymers of polyethylene and polypropylene, or physical mixtures thereof.

The films 12, 14 of the polymeric package may consist of polyethylene, polypropylene, polyesters, copolyesters, polyamides, polyacrylonitriles, or mixtures and/or laminates of those compositions.

The carrier strips in FIGS. 1–7 incorporate a gas scavenging material. The particular gas scavenging material utilized may vary depending upon the particular gas to be scavenged. For instance, a particularly effective oxygen scavenging material is a transition metal complex or chelate of an organic polycarboxylic acid, preferably an amino polycarboxylic acid, and most preferably ethylene diamine tetracetic acid ("EDTA"), or a salt thereof. Other useful oxygen scavenging compositions include ethylene diamine triacetic acid, hydroxyethylene diamine triacetic acid, diethylene triamine pentaacetic acid or trans-1,2-diamino cyclohexane tetraacetic acid. It is also possible to utilize other polycarboxylic acids, such as citric and oxalic acids, which are capable of forming a chelate with the transition metal. Such polycarboxylic compounds may contain one or more amine, hydroxyl, carboxylate or sulfhydryl groups, or combinations thereof.

Preferably, the transition metal is chosen from iron, copper, cobalt, or nickel; most preferably it is either iron or copper. The transition metal used to make the chelate or complex may be supplied as a simple salt, such as iron or copper chloride, iron, or copper sulfate, iron gluconate, nickel sulfate, or cobalt chloride.

It is also possible, and in some cases preferred, to include a reducing agent, such as an ascorbate compound, in the polymer in an amount sufficient to enhance, preserve or augment the oxygen scavenging properties of the amino polycarboxylic compound, chelate or complex. Ascorbic acid, in its D- or L-form, or a derivative, analog or salt thereof, may be used as a preferred reducing agent, since it has oxygen scavenging properties.

Further information concerning the oxygen scavenger and carrier strip material described above may be obtained from U.S. Pat. No. 5,202,052 to Zenner et al., incorporated herein by reference.

If gases other than oxygen are to be scavenged, appropriate gas scavenging materials can be incorporated into a compatible carrier strip material.

Preferred carrier materials for the carrier strips include polyolefins, polyvinyl chloride, polyurethanes, polyamides and elastomers. Polyvinyl chloride, poly(ethylene vinyl acetate), and polyester are typically utilized, but polyethylene, polypropylene, and other polyolefins, various thermoplastic (or other) polyurethanes, elastomers (such as isoprene rubber, nitrile rubber, chloroprene rubber, silicone rubber, or other rubber anaropene rubber, silicone rubber, or other rubber analogs), and other thermoplastic materials such as chlorinated polyethylene ("CPE"), SURLYN™, various combination or mixtures or mixtures thereof, are acceptable. In addition, coatings of epoxies, polyesters or other materials are useful as carriers for the gas scavenging compositions of invention.

The most preferred polymers which may be used as the carrier material are those which are permeable to water vapor at room temperature, so that exposure to elevated temperatures is not necessary to activate the gas scavenging capabilities of the composition. Advantageously, the oxygen scavenging material is maintained in a dry state. The gas scavenging material is uniformly dispersed in and throughout the polymer by a direct mixing technique. The gas scavenging capabilities of these materials are later activated by contact with water or water vapor which permeates into or through the carrier.

Method of Manufacturing the Gas Scavenging Arrangement

The present invention also provides a method of manufacturing the gas scavenging arrangement. The method generally includes the steps of forming a polymeric carrier strip carrying a gas scavenging material and locating the polymeric carrier strip within the package between the first and second polymeric films making up the package.

The closure arrangements are manufactured using conventional extrusion and heat sealing techniques. In particular, the base strips 20, 22 and the closure profiles 24, 26 are co-extruded through a die plate fed by a plurality of extruders. Additionally, the locking profile 56 in FIG. 3 designed to hold carrier strip 52 is integrally formed with base strip 20 and is similarly extruded therewith. The extruders carry the different molten materials for forming the base strips and the closure profiles. As is well-known in the art, the die plate includes input ports, output ports, and channels connecting these input ports to output ports. The extruders feed the different molten materials to different input ports, and the channels are designed to configure the molten materials into the shapes of the base strips and the closure profiles. The output ports are arranged such that the base strips and the closure profiles exit the die plate in the illustrated configurations. Since the first base strip 20 and the female closure profile 24 are separated from the second base strip 22 and the male closure profile 26, it should be apparent that these two separate sets of elements may be formed in separate extrusions using two different die plates.

To produce the finished bag, the top and bottom films making up the polymeric bag are heat-fused to the respective base strips using heat seal bars. An intermediary adhesive may be used to facilitate sealing the base strips to the polymeric packaging film.

The gas scavenging carrier material can be co-extruded with the base strip or polymeric film making up the polymeric package. Alternatively, the carrier material can be coated onto the base strip or polymeric film in a separate step. These methods of co-extrusion and coating are conventional to those skilled in the art.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gas scavenging arrangement in combination with a flexible polymeric package having first and second opposing films, said arrangement comprising at least one polymeric carrier strip carrying a gas scavenging material and disposed within the package between the first and second films and a reclosable zipper disposed at a mouth end of the package, said reclosable zipper including first and second opposing base strips having inner and outer surfaces and having their outer surfaces attached to the respective first and second films and including first and second interlocking closure profiles extending inwardly from said respective first and second base strips, said at least one carrier strip being co-extruded as a portion of the inner surface of at least one of said first and second base strips.

2. The arrangement of claim 1, wherein said at least one carrier strip is located above said first and second closure profiles such that said first and second closure profiles are closer than said at least one carrier strip to an interior of the package.

3. The arrangement of claim 1, wherein said at least one carrier strip is located below said first and second closure profiles such that said at least one carrier strip is closer than said first and second closure profiles to an interior of the package.

4. The arrangement of claim 1, wherein said at least one carrier strip is a pair of sealable strips, said sealable strips being detachably connected to each other to form a breakable seal therebetween.

5. The arrangement of claim 1, wherein said carrier strip is formed from a carrier polymer selected from the group consisting of polyolefins, polyurethanes, polyamides, elastomers, and mixtures thereof.

6. The arrangement of claim 1, wherein said gas scavenging material is an oxygen scavenger including transition metal complexes of organic polycarboxylic acids.

7. A method of manufacturing a gas scavenging arrangement in combination with a flexible polymeric package having first and second opposing films, said method comprising the steps of:

forming a first base strip having inner and outer surfaces;

forming a second base strip having inner and outer surfaces and opposing said first base strip, said first and second base strips being located in proximity to a mouth end of the package;

forming first and second interlocking closure profiles extending inwardly from said respective first and second base strips;

forming at least one carrier strip carrying a gas scavenging material by co-extruding said at least one carrier strip as a portion of the inner surface of at least one of said first and second base strips; and attaching said outer surfaces of said first and second base strips to the respective first and second films.

* * * * *